US007526899B1

(12) United States Patent
Oliver et al.

(10) Patent No.: US 7,526,899 B1
(45) **Date of Patent: *May 5, 2009**

(54) FOUNDATION SYSTEM FOR BEAM OF MANUFACTURED HOME

(76) Inventors: James Oliver, P.O. Box 9, Hohenwald, TN (US) 38462; Evon L. Oliver, P.O. Box 9, Hohenwald, TN (US) 38462; Scott Oliver, 2024 Stephens Town Rd., Linden, TN (US) 37096; Daniel Oliver, 1411 Stephens Town Rd., Linden, TN (US) 37096; John Oliver, 1480 Stephens Town Rd., Linden, TN (US) 37096

( * ) Notice: Subject to any disclaimer, the term of this patent is extended or adjusted under 35 U.S.C. 154(b) by 9 days.

This patent is subject to a terminal disclaimer.

(21) Appl. No.: 11/552,298

(22) Filed: Oct. 24, 2006

Related U.S. Application Data

(63) Continuation of application No. 10/164,166, filed on Jun. 4, 2002, now Pat. No. 7,140,157.

(51) Int. Cl.
*E02D 27/00* (2006.01)

(52) U.S. Cl. ..... 52/292

(58) Field of Classification Search ..... 52/292, 52/299, DIG. 11, DIG. 3, 167.1, 695, 741.15, 52/632; 248/188.1, 188.2, 188.91, 228.1, 248/228.6, 351

See application file for complete search history.

(56) References Cited

U.S. PATENT DOCUMENTS

| | | | | |
|---|---|---|---|---|
| 347,489 | A | | 8/1886 | Kenway |
| 709,300 | A | | 9/1902 | Buchtel |
| 1,460,283 | A | | 6/1923 | Shutsa |
| 3,195,694 | A | * | 7/1965 | De Castro ..... 52/263 |
| 3,347,002 | A | | 10/1967 | Penkukn |
| 3,380,205 | A | | 4/1968 | Ratchford |
| 3,537,724 | A | * | 11/1970 | Matthews ..... 280/763.1 |
| 3,724,151 | A | | 4/1973 | Kaywood et al. |
| 3,747,951 | A | * | 7/1973 | Brown ..... 280/762 |
| 3,750,349 | A | * | 8/1973 | Deike ..... 52/23 |
| 3,823,958 | A | | 7/1974 | Trejbal |
| 3,930,668 | A | | 1/1976 | Schuermann |
| 3,976,306 | A | | 8/1976 | Nault |
| 4,148,162 | A | | 4/1979 | Goodrich |
| 4,272,933 | A | | 6/1981 | Lopes |
| 4,348,843 | A | * | 9/1982 | Cairns et al. ..... 52/167.1 |
| 4,417,426 | A | * | 11/1983 | Meng ..... 52/126.7 |
| 4,473,239 | A | | 9/1984 | Smart |
| D276,588 | S | | 12/1984 | Fambrough |
| 4,562,673 | A | | 1/1986 | Barari |
| 4,866,797 | A | | 9/1989 | Vollan |
| 4,976,077 | A | | 12/1990 | Tucker |
| 5,359,821 | A | | 11/1994 | Merriman |

(Continued)

*Primary Examiner*—A. Joseph Wujciak, III
(74) *Attorney, Agent, or Firm*—Baker Donelson Bearman Caldwell & Berkowitz, PC

(57) ABSTRACT

A foundation system 50 for supporting a support beam 80 of a manufactured home and for preventing longitudinal movement of the beam; beam 80 having a longitudinal axis defining the longitudinal direction. Ground support pan 52 including blades 57 for insertion in the ground for preventing horizontal movement and a bracket 61 pivotably connecting lower ends 73 of a pair of rigid arms 70 substantially to the longitudinal middle of pan 53 such that arms 70 form a V. Each upper end 76 of arms 70 is pivotably attached to a clamp 10 clamped to beam 80 such that the clamp 10 cannot move along beam 80.

13 Claims, 2 Drawing Sheets

U.S. PATENT DOCUMENTS

| | | | | |
|---|---|---|---|---|
| 5,509,237 | A | 4/1996 | Coulter | |
| 5,697,191 | A | 12/1997 | MacKarvich | |
| 5,727,767 | A | 3/1998 | Jefrey | |
| 5,862,635 | A | 1/1999 | Linse | |
| 5,983,573 | A | 11/1999 | MacKarvich | |
| 6,015,138 | A | 1/2000 | Kohlberger | |
| 6,058,663 | A | 5/2000 | MacKarvich | |
| 6,119,412 | A | 9/2000 | Jackson | |
| 6,243,996 | B1 | 6/2001 | Oliver et al. | |
| 6,243,998 | B1 | 6/2001 | MacKarvich | |
| 6,381,907 | B1 * | 5/2002 | MacKarvich | 52/126.6 |
| 6,505,447 | B1 * | 1/2003 | Oliver et al. | 52/292 |
| 7,140,157 | B2 * | 11/2006 | Oliver et al. | 52/292 |
| 2003/0213197 | A1 | 11/2003 | Oliver et al. | |

* cited by examiner

FIG. 4
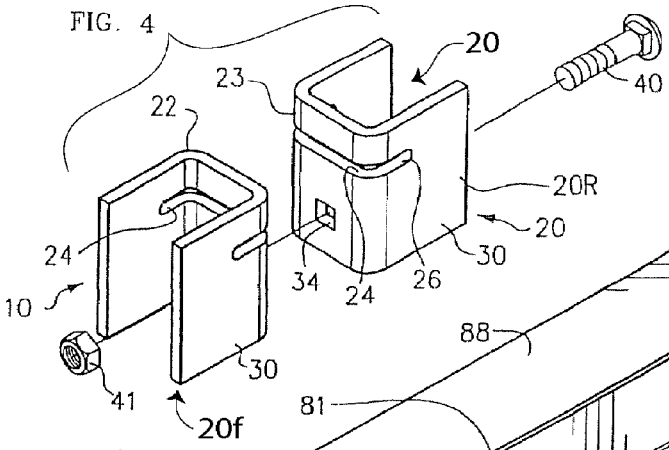
FIG. 1
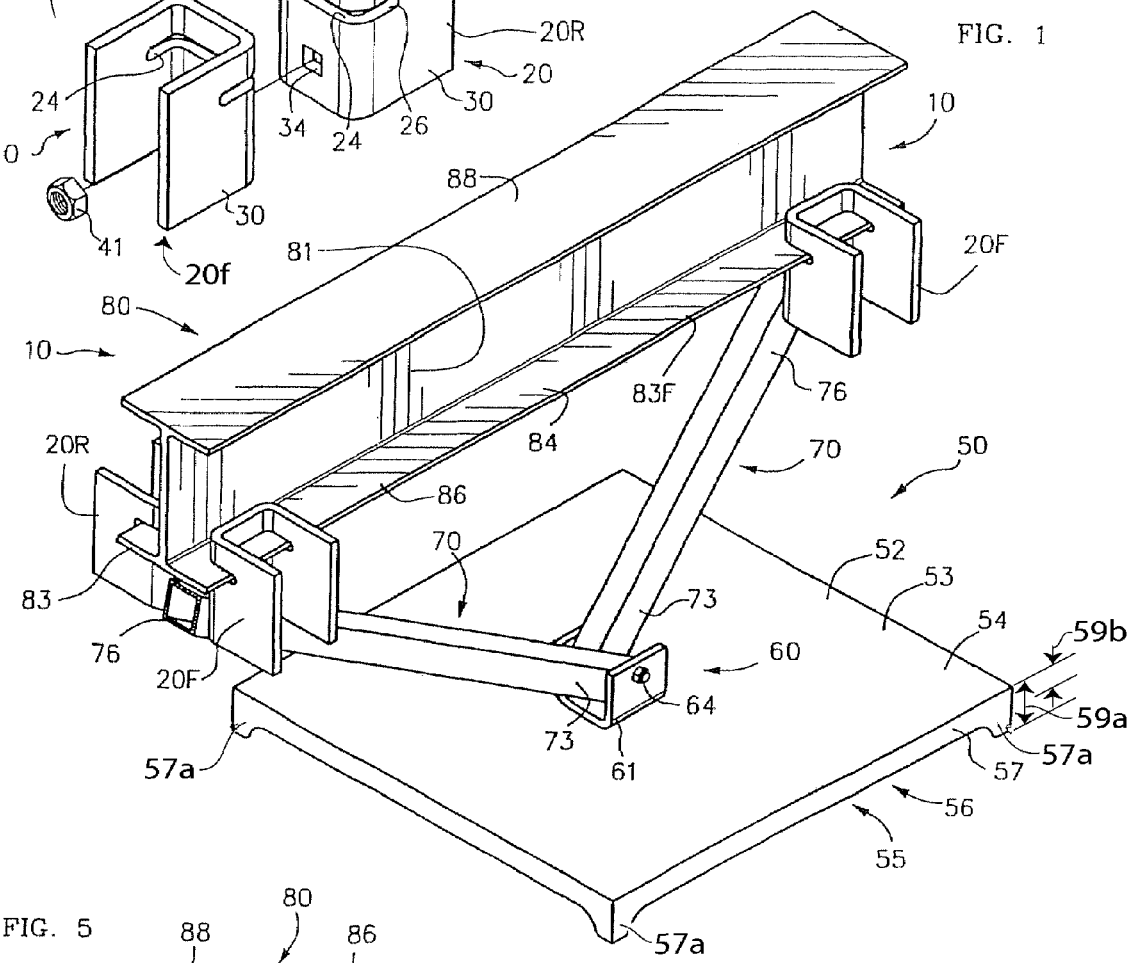
FIG. 5
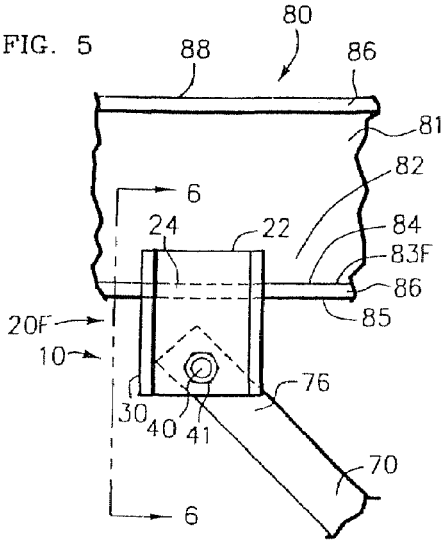
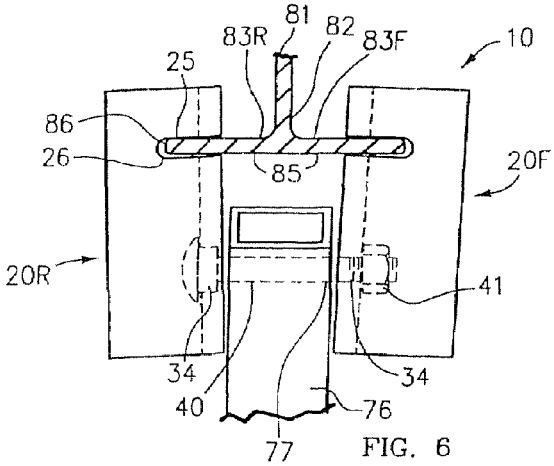
FIG. 6

FOUNDATION SYSTEM FOR BEAM OF MANUFACTURED HOME

This application is a continuation of U.S. patent application Ser. No. 10/164,166, filed Jun. 4, 2002, U.S. Pat. No. 7,140,157.

FIELD OF THE INVENTION

This invention relates to a foundation system for supporting a beam of a manufactured home and preventing the beam from moving longitudinally, thus functioning both as a pier and as longitudinal braces.

BACKGROUND OF THE INVENTION

Manufactured homes, mobile homes or trailer coaches include long longitudinal support beams underneath. Typically, when the home or coach is installed, a plurality of vertical piers or jacks are placed under the beams to support them. Most piers or jacks require placement on a rigid ground pad so as to not sink into the ground from the loading. Conventional piers do not provide resistance to longitudinal forces or lateral forces that may be exerted on the coach such as by strong winds or earthquakes. Thus, additional stabilizing and anchoring systems have to be used.

It is desirable to have an improved foundation system that both supports the beam and provides longitudinal stability.

Since many foundation systems are required for a single manufactured home and since these systems have to be installed in the field and in a confined space under a manufactured home, it is desirable that they be simple and fast to install, preferably by a single person, not require complex tools and not require any alterations to the present beams, such as drilling, that could decrease the strength of the beams.

SUMMARY OF THE INVENTION

The invention is a foundation system for supporting a support beam of a manufactured home and for preventing longitudinal movement of the beam; the beam having a longitudinal axis defining the longitudinal direction. The foundation system generally comprises a pair of rigid arms, a ground support, and a pair of clamps. Each arm has a lower end and an upper end.

The ground support includes a pan for placement on the ground including blades for insertion in the ground for preventing horizontal movement and a bracket pivotably connecting the lower ends of the arms substantially to the longitudinal middle of the pan such that the arms form a V.

A clamp is associated with each arm. Each clamp includes a bolt for pivotably attaching the upper end of its associated arm and for clamping the clamp to the support beam such that the clamp cannot move along the beam.

In another aspect, the present invention provides a ground pan for a foundation system for a manufactured home having a support beam, the ground pan comprising a planar sheet defining a top and a bottom, a connector extending from the top and adapted for engaging a support arm extending from a support beam of a manufactured home, the bottom for bearing against the ground, and, for preventing horizontal movement with ground blades extending from the planar sheet in a first direction to a distal extent that is a first distance from the top for insertion in the ground and a plurality of legs, each extending from adjacent ground blades at intersections thereof, the leg extending to a distal extent that is a second distance from the top, the second distance greater than the first distance.

The features and advantages of the invention will be readily understood when the detailed description thereof is read in conjunction with the accompanying drawings wherein like reference numerals refer to like parts throughout.

BRIEF DESCRIPTION OF THE DRAWINGS

FIG. 1 is a perspective view of an exemplary embodiment of the foundation system of the invention attached to a support beam of a manufactured home.

FIG. 4 is an exploded perspective view of a clamp for attaching the foundation system to a support beam of a manufactured home.

FIG. 5 is a partial side elevation view of the beam connection.

FIG. 6 is an end view of the beam connection taken on line 6-6 of FIG. 5.

DETAILED DESCRIPTION OF THE INVENTION

Figure 2:
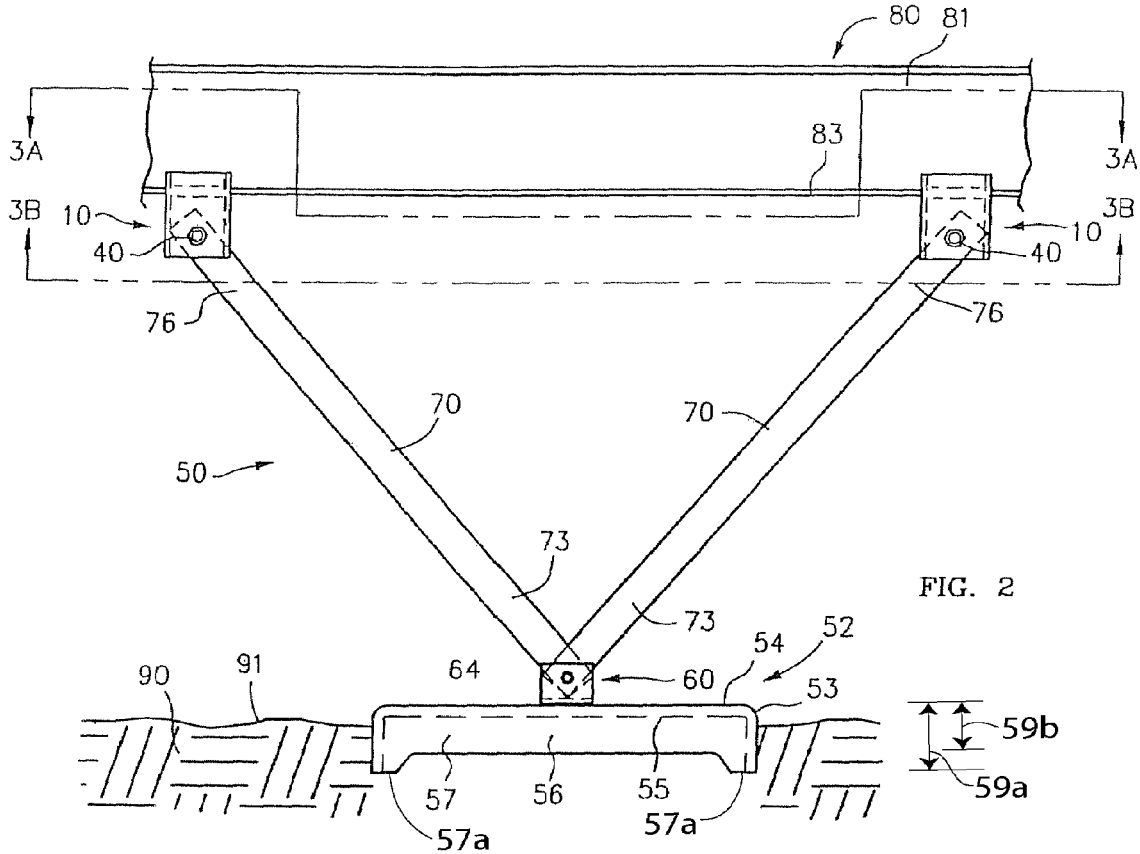
FIG. 2 is a front elevation view of FIG. 1.
Figure 3A:
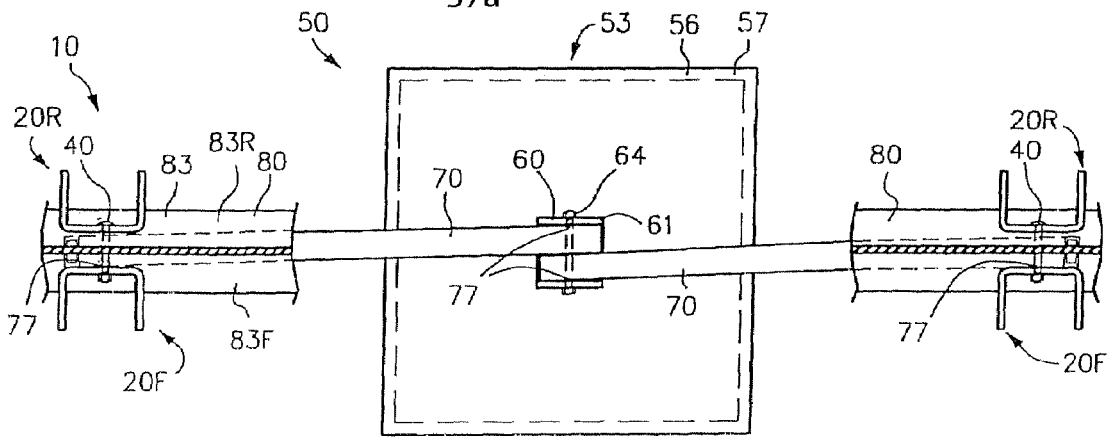
FIG. 3A is a sectional view taken on line 3A-3A of FIG. 2.
Figure 3B:
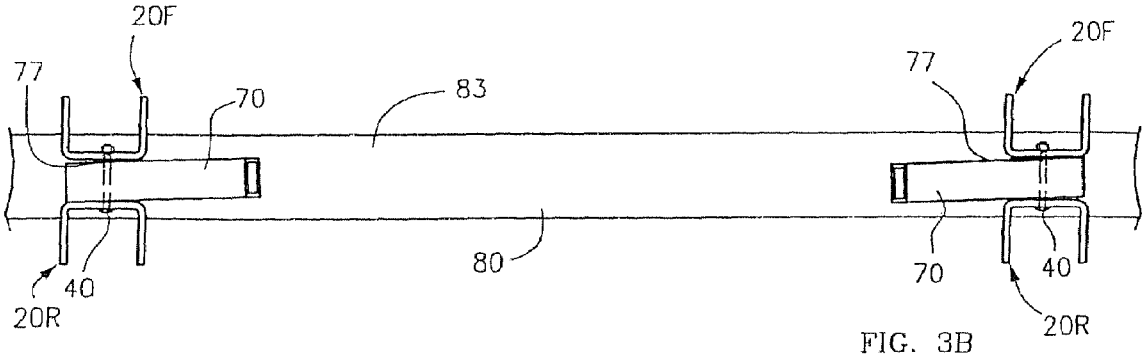
FIG. 3B is a sectional view taken on line 3B-3B of FIG. 2.

With reference now to the drawings, FIG. 1 is a perspective view of an exemplary embodiment of the foundation system 50 of the invention attached to a support beam 80 of a manufactured home. FIG. 2 is a front elevation view of FIG. 1. FIG. 3A is a sectional view taken on line 3A-3A of FIG. 2. FIG. 3B is a sectional view taken on line 3B-3B of FIG. 2.

Foundation system 50 includes a ground support means 52, a pair of rigid arms 70 and means, such as a pair of clamps 10, each clamp 10 for attaching an arm 70 to beam 80.

Each arm 70 has an upper end 76 and a lower end 73. Each upper end 76 and lower end 73 includes a bore 77 for receiving a fastener, 40, 64 respectively, for pivotable connection. Arms 70 may be of any suitably strong material, such as of one and one-half inch square steel tube.

Ground support means 52 prevents downward and horizontal movement of lower ends 73 of arms 70 and retains lower ends 73 of arms 70 in a fixed, but pivotable, position. Ground support means 52, includes a support, such as a cement footing or ground pan 53, shown, and arm connecting means 60. Ground pan 53 has a top surface 54, a bottom 55, and ground blade means 56, such as insertion perimeter 57, that is a perimeter downward extending wall. As illustrated, ground pan 53 includes a leg 57*a* at each of the corners of the ground pan 53 extending from adjacent insertion perimeters 57. The legs 57*a* extend downwardly from the ground pan to a distal extent a distance 59*a* greater than a distance 59*b* of a distal extent of the insertion perimeter 57. Ground pan 53 is placed on the ground and insertion perimeter 57 is pressed into the ground. When pan 53 is weighted, the side-facing wall of insertion perimeter 57 and the legs 57*a* prevent horizontal movement of pan 53. The area of bottom 55 of pan 53 bears against surface 91 of soil 90 and prevents downward movement. Ground pan 53 is made of strong material such as of steel. In the illustrated embodiment, the legs 57*a* are integral with the insertion perimeters 57 of ground pan 53.

Arm connecting means 60 includes a bracket, such as U-bracket 61, and bolt 64. U-bracket 61 is connected to ground pan 53 by any suitable means, such as welding, and includes bores for receiving a fastener, such as bolt 64. Bolt 64 is disposed through bores 77 for side by side lower ends 73 of arms 70 and pivotably connects lower ends 73 of arms 70 to bracket 61. Bolt 64 is located substantially in the longitudinal middle of pan 53.

FIG. 4 is an exploded perspective view of a clamp 10 for attaching foundation system 50 to support beam 80 of a manufactured home. FIG. 5 is a partial side elevation view of the beam connection. FIG. 6 is an end view of the beam connection taken on line 6-6 of FIG. 5.

Support beam 80 has a vertical web 81 and a bottom end 82 having a lateral flange 83 including a front flange 83F and a rear flange 83R. Each flange 83F, 83R has a top 84, a bottom 85, and a free end 86. Beam 80 top 88 supports a manufactured home.

Clamp 10 includes a pair of flange mount members 20, such as front member 20F and rear member 20R, and connecting means, such as an adjustable tension member, such as carriage bolt 40 and nut 41. Each flange mount member 20F, 20R includes a top 22, a medial side 23 facing web 81, and a lower portion 30. Medial side 23 includes a channel 24 adapted for receiving a flange, 83F or 83R. Channel 24 includes a top surface 25 and a bottom surface 26. Lower portion 30 is lower than channel 24 and, therefore, below flange 83F,83R when member 20 is mounted thereon. Lower end 30 includes bores 34 for receiving bolt 40. Preferably, at least one of these bores 34 is adapted, such as by being square, to prevent the head of bolt 40 from turning. In the exemplary embodiment, members 20 are made of U-shaped steel.

Clamp 10 is attached to beam 80 by mounting channel 24 of front member 20F on front flange 83F and mounting channel 24 of rear member 20R on rear flange 83R opposite front member 20F. Top end 76 of arm 70 is placed between lower end 30 of mounted members 20F, 20R and carriage bolt 40 is inserted through bores 34 and 77 to pivotably connect arm 70 to clamp 10.

Bolt 40 is tightened, such as by turning nut 41, and urges lower portions 30 of mounted members 20F, 20R together as seen in FIG. 4 such that at least one of mounted channels 24 binds on its received flange 83F, 83R and holds clamp 10 in place on beam 80.

Preferably, channels 24 have a depth such that mounted members 20F, 20R are sufficiently separated such that there is more than enough room for upper end 76 of arm 70 to fit therebetween and such that tightening bolt 40 pulls lower ends 30 together and tilts them so as to bind. Channels 24 have a height such that forcing lower ends 30 outward or inward so as to tilt members 20, such as by tightening bolt 40, binds channels 24 on flange 83 such that clamp 10 cannot move. In this manner, tightening a single bolt 40 clamps clamp 10 in a given location on beam 80. Clamp 10 can be used to support beam 80 and prevent beam 80 from longitudinal movement.

To use foundation system 50, a manufactured home is first supported by any suitable temporary means, such as piers or jacks, well-known in the art. Pan 53 is placed on surface 91 of soil 90 ground under support beam 80 of a manufactured home and blade or insertion perimeter 57 is pressed into soil 90. Lower ends 73 of arms 70 are pivotably attached, such as by a single bolt 64, to pan 53. Each clamp 10 is pivotably attached to upper end 76 of its respective arm 70 and to lower flange 83 of beam 80, each such as by a single bolt 40. The temporary supports can now be removed.

Arms 70 pivot so as to attach anywhere along beam 80. The spacing between beam 80 and ground surface 91 is not critical as it only changes the angle of the "V" of arms 70. Therefore, arms 70 do not need to be adjustable in length. Arms 70 of a single length may likely be useable for supporting a given home regardless of irregularities in ground level. Preferably, arms 70 are raised an angle of 40 to 60 degrees. In general, the smaller the angle, the greater the prevention of longitudinal movement of beam 80.

It has been found that pivotably attaching arms 70 to the longitudinal middle of pan 53 prevents pan 53 from lifting and causing failure if beam 80 attempts to move longitudinally. Beam 80 is both supported and prevented from longitudinal movement by tightening just three bolts. No drilling is required.

From the foregoing description, it is seen that the foundation system of the invention provides an extremely simple, efficient, and reliable manner for supporting a support beam of a manufactured home and for preventing longitudinal movement of the beam.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A foundation system for supporting a support beam of a manufactured home and for preventing longitudinal movement of the beam, the beam having a longitudinal axis defining a longitudinal direction and a bottom end including a laterally extending front flange and rear flange, each of the front flange and rear flange having a top, a bottom, and a free end, said foundation system comprising:

a pair of rigid arms jointly forming a V, each arm including a lower end and an upper end;

a ground pan for preventing downward and horizontal movement, the ground pan defining a top and a bottom, the bottom for bearing against the ground, and the ground pan including for preventing horizontal movement:

ground blades extending from a perimeter of the ground pan in a first direction to a distal extent that is a first distance from the top for insertion in the ground, and;

a plurality of legs, each extending from adjacent ground blades at intersections thereof, the leg extending to a distal extent that is a second distance from the top, the second distance greater than the first distance;

an arm connector for pivotably connecting said lower ends of both said arms with a single bolt to said ground pan, said arms pivoting about the bolt;

a pair of clamps, each clamp associated with one of said upper ends of said arms and each clamp including:

attachment means for pivotable attachment to said upper end of its associated said arm; and clamping means for clamping said clamp to the front and rear flanges of the lateral flange of the bottom end of the support beam such that said clamp cannot move along the beam; said lower ends of said arms connected to said ground support means so as to be freely pivoting such that, responsive to supporting the beam, each said clamp exerts an upward force supporting the beam and a resultant longitudinal force on the beam.

2. The foundation system of claim 1 wherein said attachment means and said clamping means each comprises a single fastener such that only three fasteners are required to pivotally connect said arms to said ground support means, pivotally attach said arms to said clamps and clamp said clamps on the beam.

3. The foundation system of claim 1 wherein said arm connector pivotably connect said lower ends of said arms substantially to the longitudinal middle of said ground pan.

4. In combination a foundation system, comprising:

a horizontal support beam for a manufactured home, the beam having a longitudinal axis defining a longitudinal direction and said beam including: a bottom end including: a lateral flange including: a front flange; and a rear flange; each flange having a top, a bottom, and a free end;

a foundation system supporting said support beam and for preventing longitudinal movement of said beam, said foundation system comprising:

a pair of rigid arms jointly forming a V, each arm including a lower end and an upper end;

a ground pan for preventing downward and horizontal movement, the ground pan defining a top and a bottom, the bottom for bearing against the ground, and the ground pan including for preventing horizontal movement:

ground blades extending from a perimeter of the ground pan in a first direction to a distal extent that is a first distance from the top for insertion in the ground and;

a plurality of legs, each extending from adjacent ground blades at intersections thereof, the leg extending to a distal extent that is a second distance from the top, the second distance greater than the first distance;

an arm connector pivotably connecting said lower ends of both said arms with a single bolt to said ground pan and about which both said arms pivot;

a pair of clamps, each clamp associated with one of said upper ends of said arms; each clamp including:

attachment means for pivotable attachment to said upper end of its associated said arm; and clamping means for clamping said clamp to the front and rear flanges of the lateral flange of the bottom end of the support beam such that said clamp cannot move along the beam; said lower ends of said arms connected to said ground support means so as to be freely pivoting such that, responsive to supporting the beam, each said clamp exerts an upward force supporting the beam and a resultant longitudinal force on the beam.

5. The combination of claim 4 wherein said arm connector pivotably connect said lower ends of said arms substantially to the longitudinal middle of said ground pan.

6. The combination of claim 4 wherein: said attachment means and said clamping means each comprises a single fastener such that only three fasteners are required to pivotably connect said arms to said ground support means, pivotably attach said arms to said clamps, and clamp said clamps on said beam.

7. The combination of claim 6 wherein:

each said clamp includes:

a front member including:

a top;

a medial side facing said beam including:

a channel adapted for receiving said front flange including:

a top surface; and a bottom surface; and a lower portion lower than said channel;

a rear member including:

a top;

a medial side facing said beam including:

a channel adapted for receiving said rear flange including:

a top surface; and a bottom surface; and a lower portion lower than said channel; and said attachment means and said clamping means connect said lower portions of said clamp members for urging them together such that at least one said channel binds on its received said flange and holds said clamp in place on said support beam.

8. A method of supporting a support beam of a manufactured home and for preventing longitudinal movement of the beam, the beam having a longitudinal axis defining the longitudinal direction and the beam including a bottom end including a laterally extending front flange and rear flange, each of the front flange and the rear flange having a top, a bottom, and a free end; the method comprising the steps of:

(a) supporting the beam with temporary support means for temporarily supporting the beam;

(b) providing a pair of rigid arms, each arm including a lower end and an upper end;

(c) providing a ground pan on the ground underneath the beam for supporting the beam and preventing downward and horizontal movement of the beam and an arm connector for pivotably connecting both of the lower ends of the arms to the ground pan, the ground pan defining a top and a bottom, the bottom for bearing against the ground and, for preventing horizontal movement with ground blades extending from a perimeter of the ground pan in a first direction to a distal extent that is a first distance from the top for insertion in the ground, and a plurality of legs, each extending from adjacent ground blades at intersections thereof, the leg extending to a distal extent that is a second distance from the top, the second distance greater than the first distance;

(d) pivotably connecting the lower ends of the arms with the arm connector to the ground pan by passing a single fastener through both lower ends of the arms such that the arms freely pivot;

(e) providing a pair of clamps, each clamp associated with said upper end of one of the arms;

(f) pivotably attaching the upper end of each arm to its associated clamp;

(g) clamping the clamps to the support beam such that the clamps cannot move along the support beam; and (h) unsupporting the beam with the temporary support means such that each clamp exerts an upward force supporting the beam and a resultant longitudinal force on the beam.

9. The method of claim 8 wherein the step of clamping each clamp to the beam includes tightening a single fastener such that only three fasteners are required to pivotably connect the arms to the ground support means, pivotably attach the arms to the clamps, and clamp the clamps on the beam.

10. The method of claim 8 further including the steps of:

placing the ground pan on the ground under the beam; and inserting the ground blades and legs into the ground for preventing horizontal movement.

11. A ground pan for a foundation system for a manufactured home having a support beam, said ground pan comprising:

a planar sheet defining a top and a bottom;

a U-shaped connector extending from the top and having opposing side walls that each define an opening aligned with the opposing opening;

a single bolt extending through the openings in the side walls for engaging a lower end of at least one support arm extending from a support beam of a manufactured home such that the support arm pivots;

the bottom for bearing against the ground;

ground blades extending from the planar sheet in a first direction to a distal extent that is a first distance from the top for insertion in the ground for preventing horizontal movement; and a plurality of legs, each extending from adjacent ground blades at intersections thereof, the leg extending to a distal extent that is a second distance from the top, the second distance greater than the first distance.

12. The ground pan as recited in claim 11, wherein the legs are integral with the ground blades.

13. The ground pan as recited in claim 11, wherein the ground blades extend from a perimeter of the planar sheet.

* * * * *